US007678032B2

(12) United States Patent
Footnick

(10) Patent No.: US 7,678,032 B2
(45) Date of Patent: Mar. 16, 2010

(54) EXERCISE APPARATUS, METHOD OF USING AND/OR CONFIGURING SAME

(76) Inventor: Roman Footnick, 1207 Masters Way, Kingwood, TX (US) 77339

( * ) Notice: Subject to any disclaimer, the term of this patent is extended or adjusted under 35 U.S.C. 154(b) by 0 days.

(21) Appl. No.: 12/229,306

(22) Filed: Aug. 21, 2008

(65) Prior Publication Data

US 2009/0088303 A1 Apr. 2, 2009

Related U.S. Application Data

(60) Provisional application No. 60/965,553, filed on Aug. 21, 2007.

(51) Int. Cl.
*A63B 21/008* (2006.01)
*A63B 21/04* (2006.01)
*A63B 21/00* (2006.01)

(52) U.S. Cl. ..... 482/111; 482/129; 482/137

(58) Field of Classification Search ..... 482/111, 482/112, 123, 129, 130, 72, 73, 95, 96, 133–137
See application file for complete search history.

(56) References Cited

U.S. PATENT DOCUMENTS

D230,613 S * 3/1974 Coker ..... D21/673
4,275,882 A * 6/1981 Grosser et al. ..... 482/112
4,397,462 A * 8/1983 Wilmarth ..... 482/113
4,576,377 A * 3/1986 Wolff ..... 482/113
4,618,144 A * 10/1986 Gibson ..... 482/138
5,058,887 A * 10/1991 Patterson ..... 482/113
D394,482 S * 5/1998 Colonello ..... D21/673
6,290,630 B1 * 9/2001 Boland ..... 482/130
7,357,759 B2 * 4/2008 Bonnell ..... 482/72
2004/0043877 A1 * 3/2004 Brown ..... 482/123

* cited by examiner

*Primary Examiner*—Loan H Thanh
*Assistant Examiner*—Allana Lewin
(74) *Attorney, Agent, or Firm*—Alberto Q. Amatong, Jr.; The Amatong Law Firm, PLLC

(57) ABSTRACT

An exercise apparatus is disclosed having a base, an longitudinally extending bottom member rail directed generally transverse to the base, and an upright support. The exercise apparatus also has a lever arm, including an exercise bar, that is connected to the upright support and pivotable thereabout. The lever arm of the exercise apparatus is movable to a folded stage adjacent the upright support, and the bottom rail is movable toward the upright support to a folded stage, adjacent the folded lever arm in the folded stage.

15 Claims, 8 Drawing Sheets

EXERCISE APPARATUS, METHOD OF USING AND/OR CONFIGURING SAME

The present application claims the benefit of the filing date of U.S. Provisional Application Ser. No. 60/965,553 filed on Aug. 21, 2007 (now pending) (which is hereby incorporated by reference for all purposes and made a part of the present disclosure).

BACKGROUND OF INVENTION

The present invention relates generally to an exercise apparatus and, methods of using and/or stowing, configuring and/or transporting the same.

The demands on today's population further emphasize the need for regular exercise. These demands include time demands, and physical and mental stress in the workplace or home. These same demands can, however, make it very difficult for a person, particularly busy professional or parent, to make time in his/her schedule for exercise. A home exercise equipment industry has emerged to address this dilemma, and, fueled by ever increasing market demands, this industry has grown rapidly over the last few decades.

With the industry's growth, a wide variety of home exercise equipment, including home gyms, has been introduced into the marketplace, with varying success. As a substitute for a fully equipped, commercial gym, home exercise equipment should provide a wide range of exercises for the user. On the other hand, the user often has a limited space in which to exercise and to store and maintain the exercise equipment. Accordingly, there remains a need for exercise equipment that provides a wide range of exercise capabilities for the user, while requiring minimum storage and maintenance space. Furthermore, there remains a need for such an exercise apparatus that is easy to use, easy to assemble, mobile, and/or can be transported for stowage.

SUMMARY OF THE INVENTION

In one aspect of the present invention, an exercise apparatus is provided. The exercise apparatus has a base, a longitudinally extending bottom member directed generally transverse to the base, and an upright support. The exercise apparatus also has a lever arm, including an exercise bar, that is connected to the upright support and pivotable thereabout. The lever arm of this inventive exercise apparatus is movable to a folded stage adjacent the upright support, and the bottom member is movable toward the upright support to a folded stage, preferably adjacent the folded lever arm in the folded stage. Also, the bottom member is preferably positioned in the folded stage, generally in parallel relation with the folded lever arm and with the upright support. Most preferably, each of the base, bottom rail, and upright support is a slender structural member.

In another aspect of the present invention, an exercise apparatus is provided having a base, a longitudinally extending bottom member directed generally transverse to the base, an upright support, and a lever arm including an exercise bar connected to the upright support and pivotable thereabout. The lever arm and upright support are relatively disposed such that the lever arm is rotatable through about 180 degrees from between a top position and a bottom position.

In yet another aspect of the present invention, a method of configuring an exercise apparatus for stowage is provided. The method entails providing an exercise apparatus in a configuration for exercise use, wherein the exercise apparatus has a base, a longitudinally extending bottom member directed generally transverse to the base, an upright support, and a lever arm, including an exercise bar, connected to the upright support. The method further includes moving the lever arm relative to the upright support to a folded stage adjacent the upright support, and moving the extend bottom member relative to the base and toward the upright support to a folded stage.

BRIEF DESCRIPTION OF THE DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION

The present invention relates generally to an exercise apparatus, and further, features and improvements that may be applicable to various types of exercise apparatus. The inventive apparatus provides an improved structural configuration that translates into a wider range of exercise or kinetic capabilities, greater structural and dynamic integrity, and/or a more practical and convenient household apparatus.

FIGS. 1-6 depict an exemplary exercise apparatus 100 embodying various aspects of the present invention. The exercise apparatus 100 employs a rigid, rotatable exercise bar 115 that is interconnected with a hydraulic actuator 112. Movement of the exercise apparatus 100 requires energy to be expended by the user, against resistance provided by the actuator 112. Because various aspects of the invention are particularly suited for such an exercise apparatus, much of the following detail description is provided in the context of this type of exercise machine. It is contemplated, however, that the various aspects of the inventive exercise apparatus may be applicable to other machinery, in particular, exercise apparatuses. Variations of the exercise apparatus are contemplated, including those that do not include certain components of the illustrated apparatus and/or include accessories not depicted in the Figures. The detailed description of the exemplary embodiment should not, therefore, be construed as limiting the invention to the structures, configurations, and methods described herein.

Figure 1:
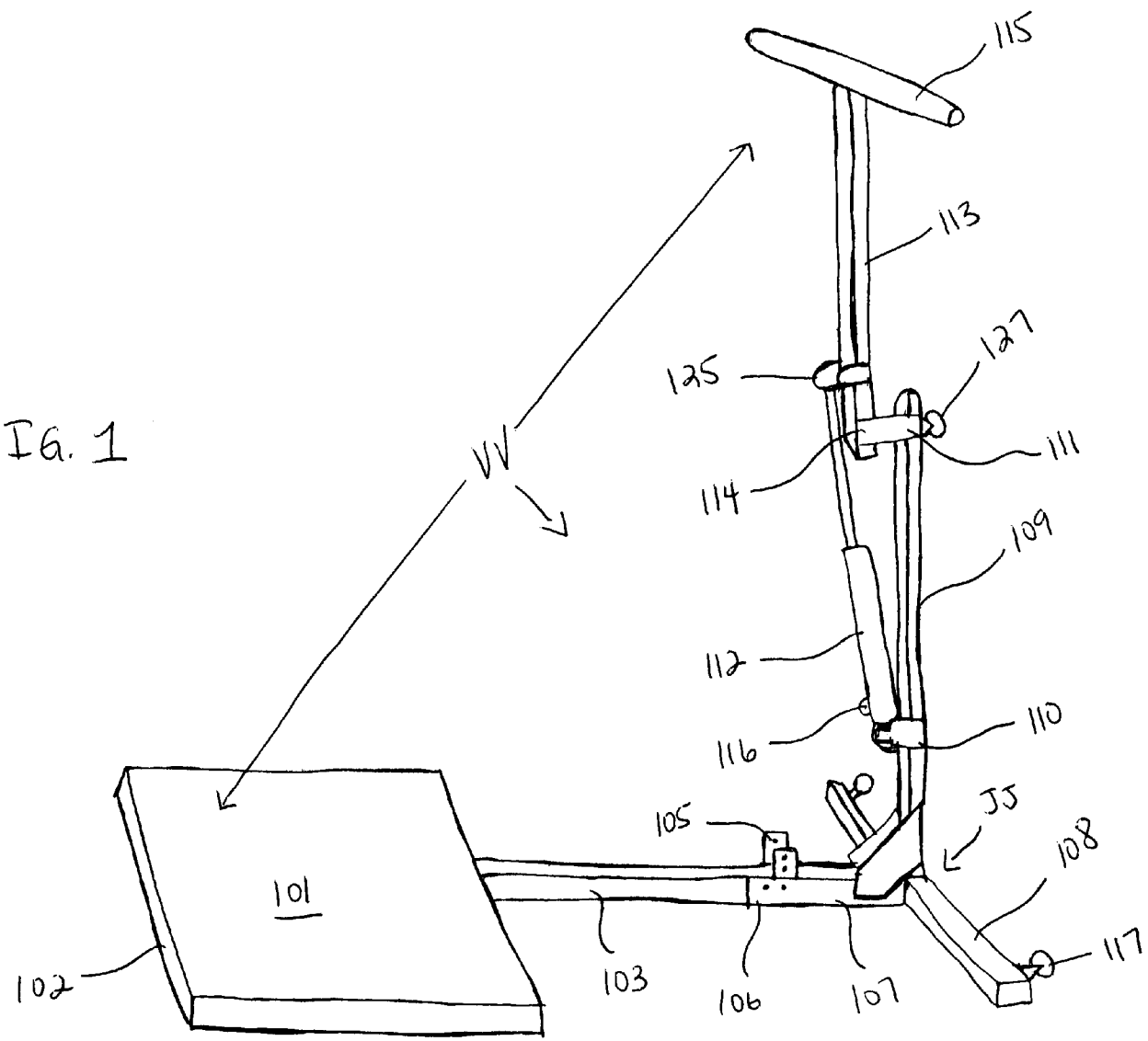
FIG. 1 is a perspective view of an exercise apparatus, according to the present invention.
Figure 2:
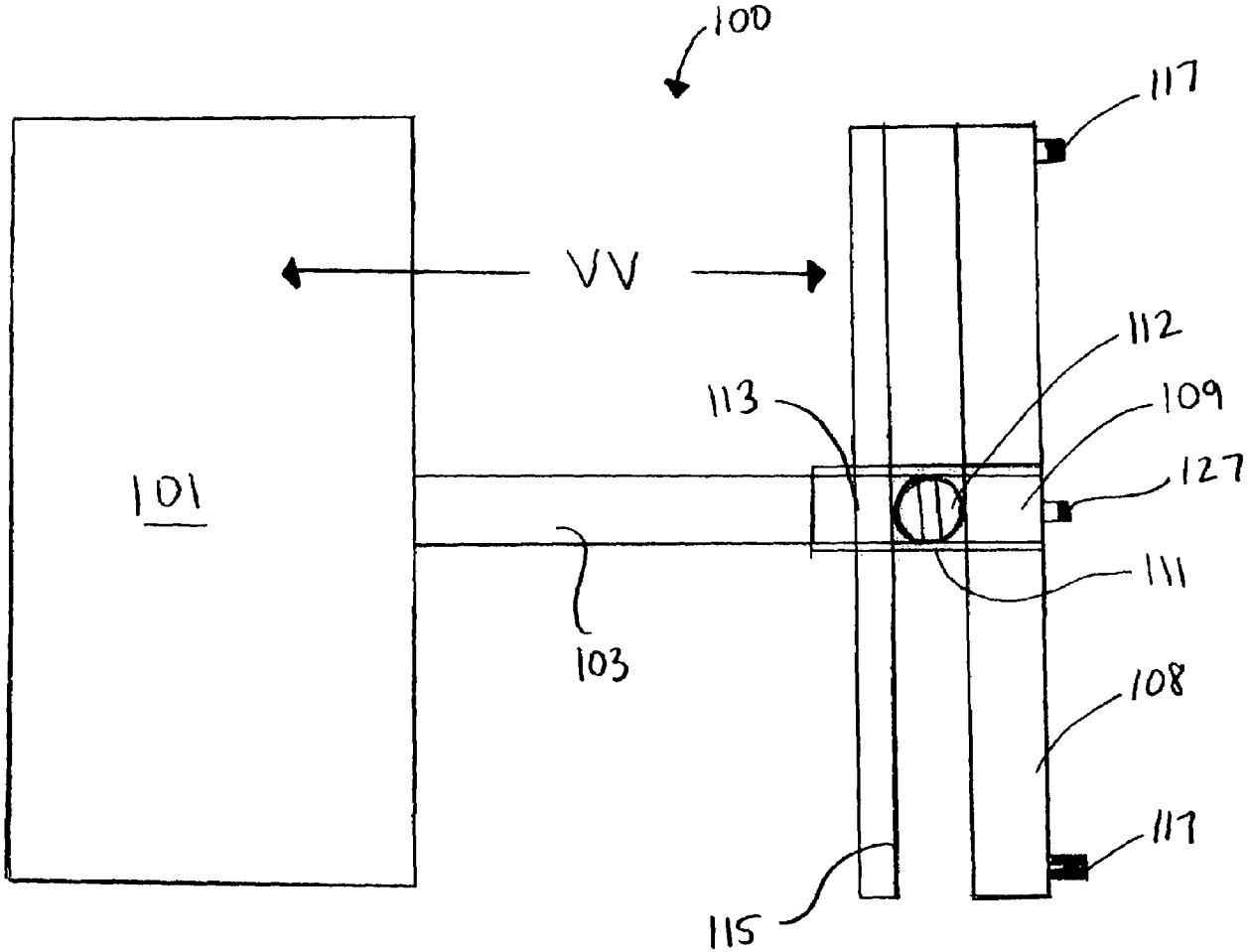
FIG. 2 is a top view of the exercise apparatus in FIG. 1.

Referring first to the perspective view of FIG. 1, an exercise apparatus 100, according to the present invention, includes a longitudinally extending bottom member or bottom rail 103, a base rail 108 connected with the bottom member 103 and extending generally transversely thereof, and an upright bar or support 109 extending upwardly from the base rail 108. The bottom member 103 and the upright bar or support 109 are each connected generally perpendicularly to the base rail 108 at a joint JJ located midway across the length of the base rail 108. The bottom member 103 advantageously includes a stationary first rail portion 107 attached to joint JJ. The bottom member 103 is connected to the stationary rail portion 107 at a pivot 106 on a distal end of the stationary rail portion 107. As will be further discussed below, the extended bottom member 103 is movable and pivotable about pivot 106 upwardly by about 90°.

Each of the bottom member 103, base rail 108, upright support 109, and other structural components of the exercise apparatus 100 may be provided by any suitable structural components generally known and commercially available, including beams, rods, tubes, channels and the like. Each of these structural members is a load bearing members having one dimension substantially greater than the other dimensions (i.e., length, longitudinal axis). Categorically, these components are referred to as simple, one-dimensional or slender structural members. It is noted that the terms rail, beam, support, and base may be used in this Detailed Description, and in the claims which follow, interchangeably with any other slender structural members (such as beams, channels, tubes, rods, and the like). As will become apparent herein, the use of these slender structural members provide advantages in terms of weight (reduced), strength (maintained), space (minimum space requirements), flexibility and mobility, and mutual conformity of components (e.g., foldability) of the inventive exercise apparatus.

The bottom member 103 extends from adjacent the joint JJ of the stationary rail portion 107 to a distal end provided by a platform 101. The platform 101 is preferably rectangular in shape and has a size and a dimension, i.e., width, larger than the average width of the extended bottom rail 103. The platform 101 servers as a platform or stage for the user during exercise. As will become apparent with further description below, the platform 101 is suitably spaced from the upright support 109 to facilitate use of the exercise bar 115.

The upright support 109 may be further characterized as including or supporting a lever arm 113 interconnected therewith by way of a forwardly extending lever bracket 111 (sometimes referred to herein as a "lateral extension arm" of the upright support 109). The lever bracket 111 and upright support 109 may be referred together as one fixed, upright support 109, with the lever bracket 111 serving as a lateral extension of the vertically-extending, lower portion (upright support 109). The lever bracket 111 connects, at a proximal end, to the upright bar 109 just below a top end of the upright support 109. A hinge 114 is mounted about a distal end of the lever bracket 111 and pivotably supports a bottom end of the lever arm 113, thereby allowing for rotatable movement of the lever arm 113 relative to the lever bracket 111 and the upright bar 109. In a manner known in the art, the hydraulic actuator 112 is operably and movably connected to the lever arm 113, thereby providing resistance to rotational motion of the lever arm 113. The hydraulic actuator 112 is connected to the lever arm 113 by way of an upper actuator bracket 125 (i.e., pin connection) positioned on the lever arm 113 near the hinge 114. A lower end of the actuator 112 is connected to the upright bar 109 at a lower actuator bracket 110 (i.e., pin connection) located well below the lever bracket 111. Through this arrangement, energy applied to the lever arm 113 is transferred to and substantially absorbed by the actuator 112. Residually, some energy is transferred to the upright bar 109 and consequently to the base rail 108 and bottom member 103 of the exercise apparatus 100. As also known in the art, the hydraulic actuator 112 is further equipped with a means for adjusting the resistance provided against movement of the lever arm 113. An adjustment dial 116 positioned on the actuator 112 allows for ready adjustment by the user before or during exercise.

The lever arm 113 also has an exercise bar 115 that is manipulated by a user during exercise. By gripping and then, pushing or pulling upon the exercise bar 115, a user can rotate the lever arm 113 about the hinge 114. The hydraulic actuator 112 provides resistance to upwardly or downwardly rotation of the lever arm 113, thereby requiring the user to expend additional energy to move the exercise bar 115 through a range of rotational motion. The user may use the adjustment dial 116 to vary the resistance provided to the lever arm 113. Resistance is preferably provided during both pushing and pulling of the lever arm 113 and thus, during both retraction and extension of the actuator 112.

Figure 3:
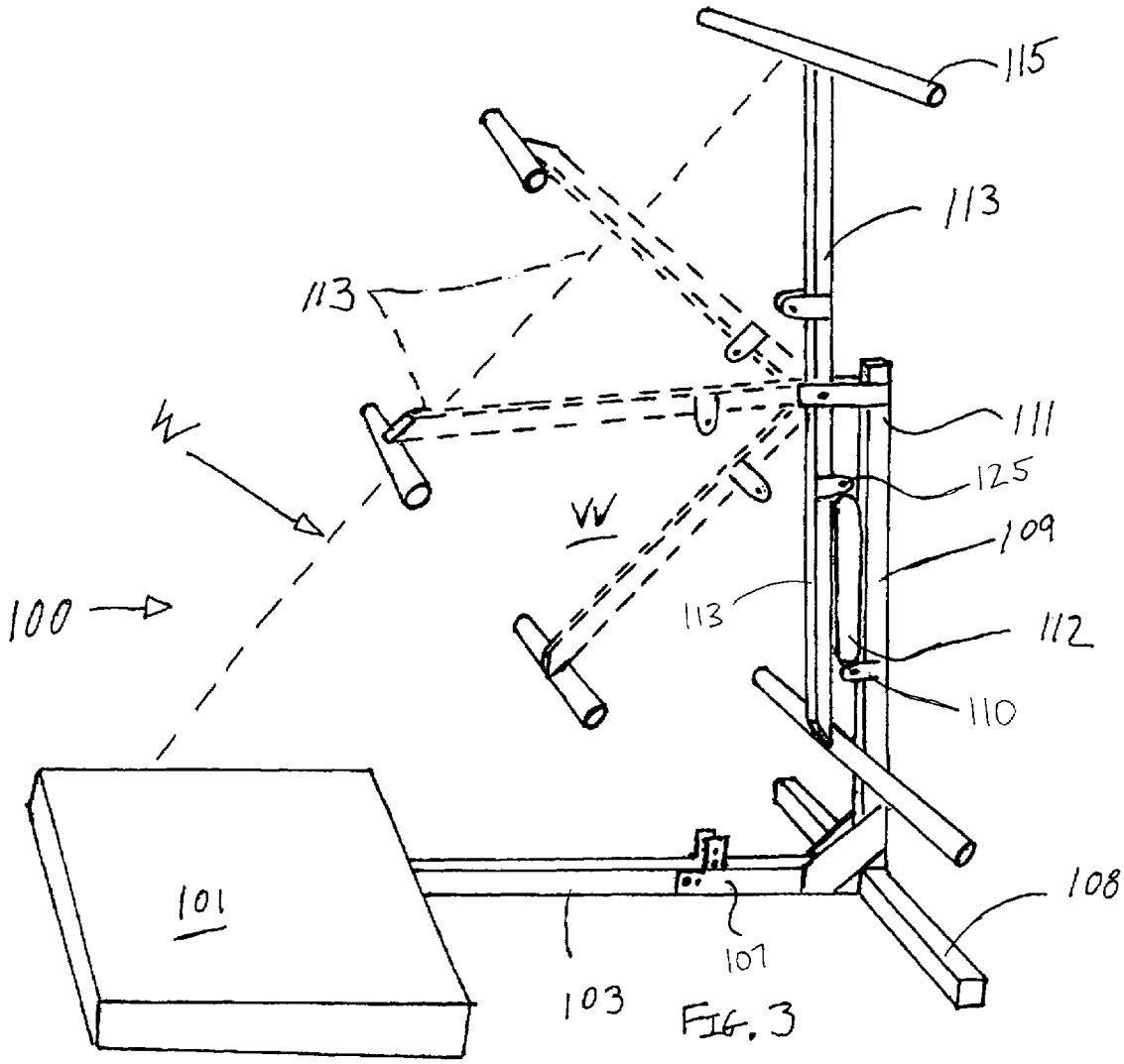
FIG. 3 is a perspective illustration of a movable or dynamic range of an exercise bar of the exercise apparatus in FIG. 1.
Figure 4:
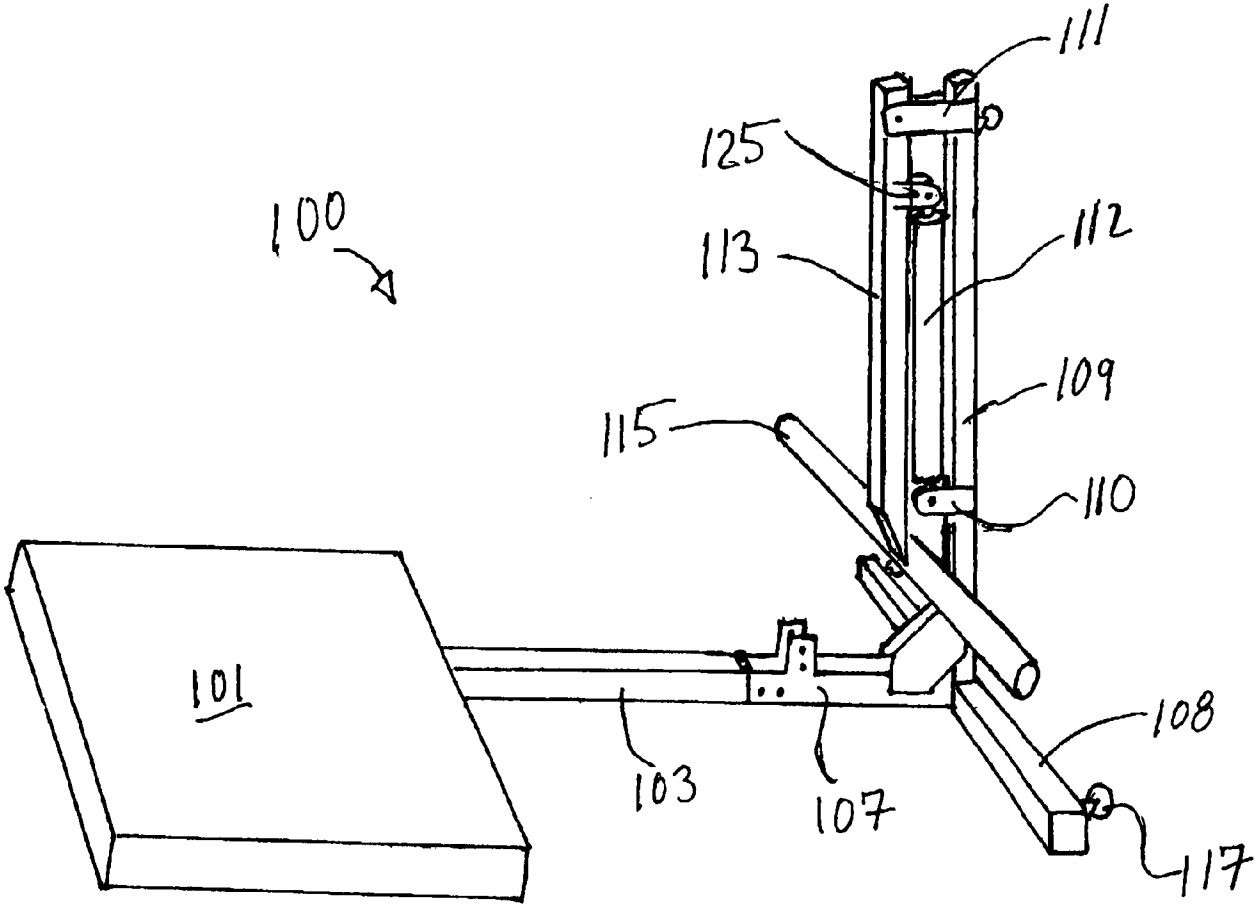
FIG. 4 is a perspective view of the exercise apparatus in FIG. 1, in a semi-folded stage.
Figure 4A:
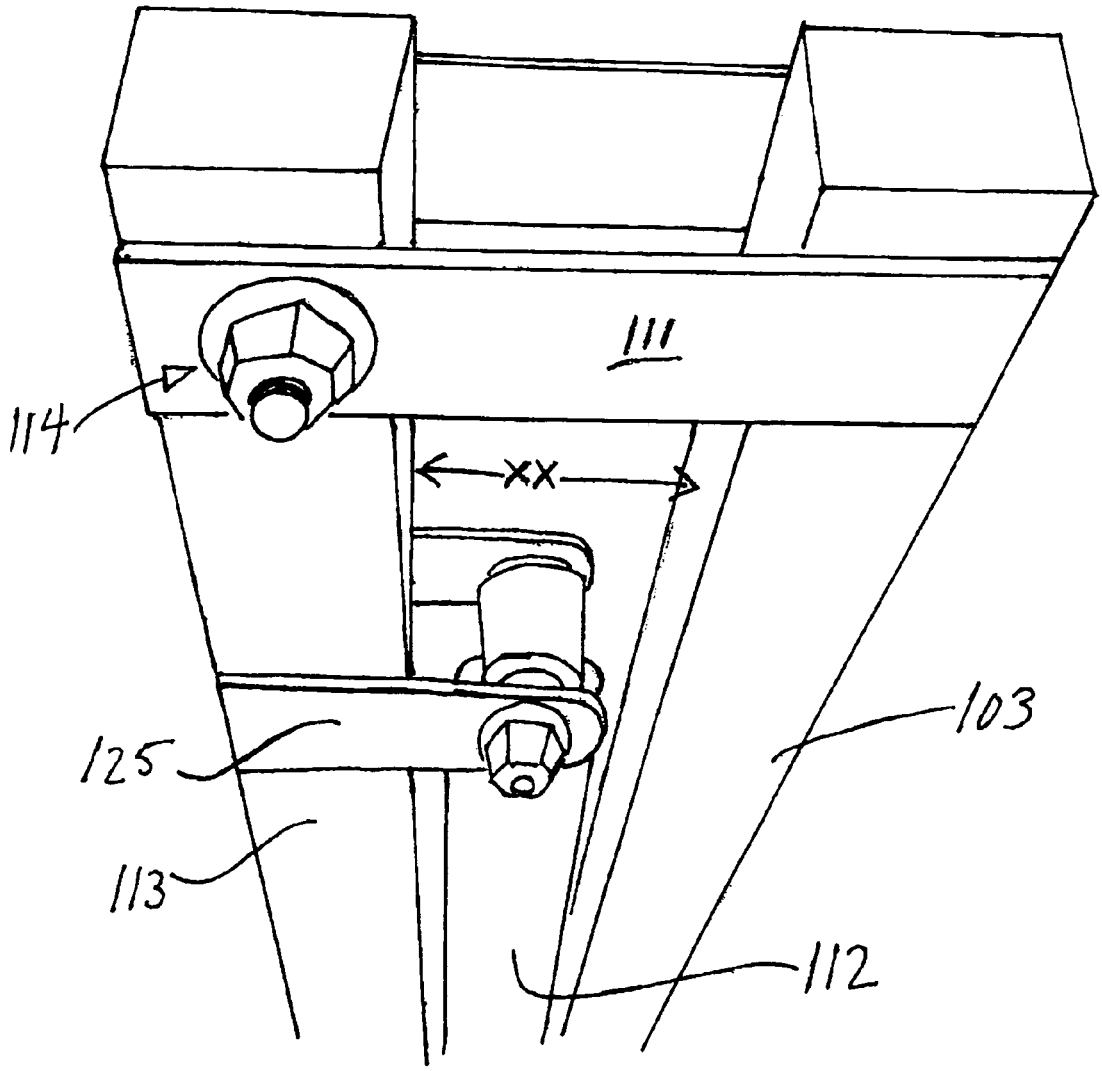
FIG. 4A is a detailed perspective view of a pivot portion of the semi-folded exercise apparatus in FIG. 4.

FIG. 3 illustrates the range of motion of the lever arm 113 and the exercise apparatus 100. FIG. 4 illustrates an end or bottom position of the lever arm 113, wherein the lever arm 113 is generally extended 180° from the topmost position and is generally parallel with upright support 109. FIG. 4A provides a detail illustration of the area of the lever bracket 111 when the lever arm 113 is at the 180° position. Notably, the actuator 112 and the lever arm 113 are compactly situated in a space XX beneath the lever bracket 111, and the upright support 109, the actuator 112, and the lever arm 113 are positioned in generally mutual parallel relation. The actuator bracket 125 is generally horizontally disposed and has traveled to a position within the space XX above the actuator 112 and to the right (in the view of FIG. 4A) of the lever arm 113.

In respect to the preferred embodiment of the invention, the platform 101 is further supported by a base board 102, having a weight and mass that is predetermined relative to the base rail 108 and upright bar 109, and the energy applied to and absorbed by the actuator 112 and upright support 109 during exercise. In this way, the platform 101 and base board 102 easily counters the weight and any moment created by and through the upright bar 109 (during exercise). Moreover, the platform 101 is preferably made sufficiently wide to accommodate the preferred stance of a user. In some applications, the weight of the user also adds stability to the exercise apparatus 101. More preferably, the platform 101 is foam-padded to cushion and accommodate the user standing thereon during exercise.

Moreover, the bottom member 103 is sufficiently extended from the base rail 108 and upright bar 109 so that the weight of the platform 101 and baseboard 102 effectively counters the moment applied at the joint JJ. The platform 101 is also conveniently spaced from the upright bar 109 and base rail 108 to correspond with the length of the lever arm 113 and to accommodate the rotation of the lever arm 113. Preferably, the user stands on the platform 101 and readily manipulate the exercise bar 115 through a range of motion corresponding to a variety of exercise routines (e.g., overhead press, row, etc.). With particular reference to FIG. 1, wherein the lever arm 113 and exercise bar 115 are positioned at a topmost orientation (i.e., 0°), an active exercise space VV is framed within the vertical upright bar 109 and the horizontal extension of the bottom rail 103 and platform 101. As further illustrated in FIG. 3, the active exercise space VV accommodates a 180° dynamic range of the lever arm 113 and exercise bar 115, including full horizontal extension (90°) of the lever arm 113 and downwardly vertical extension (180°). The active exercise space VV, according to the invention, further accommodates a user who is generally upright at one or more stages of exercise, and is standing on the platform 101. The exercise space VV includes this position of the user and allows the user of a generally normal height to access and manipulate the exercise bar 115 through the applicable range of motion. Moreover, the structural configurations of the exercise apparatus 100 allows for the exercise space VV to be vacant and thus, be unobstructed, save the movement of the exercise bar 115 therethrough.

Further, the combination of the platform 101 and base rail 108 provides a stability required of the exercise apparatus 100, particularly when the lever arm 113 is pivoted about the hinge 114 with force and impact, and also, when the hydraulic actuator 112 is pivoted about the bracket 110. As will become apparent to one skilled in the relevant mechanical art, such force exerted by the user through use of the exercise bar 115 in this manner is ultimately transferred to the upright bar 119, and further, to the base rail 108 and base board 102. Importantly, during and after such transfer of energy, the exercise apparatus 100 does not incur a resistant and reactive force, as the energy is effectively distributed and dissipated by the actuator 112 and through the mass of the exercise apparatus 100 and a surface SS beneath the exercise apparatus 100.

Referring now to FIG. 4, the exercise bar 115 and lever arm 113 are movable through a range of rotational motion in accordance with one aspect of the present invention. Preferably, the exercise apparatus 100 has been configured as shown in FIGS. 1-5 so as to facilitate a range of motion spanning about 180°. As referred to herein, the exercise apparatus 100 may also be described as being configured to accommodate a dynamic range of motion of the lever arm 113, which design takes into account not only the travel of the lever arm 113, but the impact and energy encountered during such travel. In FIG. 1, the lever arm 113 is shown pivoted upwardly about the hinge 114 to a topmost, generally vertical orientation. In this orientation of lever arm 113, the hydraulic actuator 112 is at an orientation slightly less than vertical, as determined by the location of pin connections at brackets 110, 125. By extending the upper actuator bracket 125 forwardly but proximate the bottom of the lever arm 113, the actuator 112 can accommodate the topmost orientation of lever arm 113. In a further aspect of the invention, the lever bracket 111 is extended laterally to form the space XX to accommodate the hydraulic actuator 112 and the upper actuator bracket 125 during rotation and travel to the rest or end position depicted in FIG. 5A. Furthermore, the upper actuator bracket 125 is located sufficiently forward of the lever bracket 111, or lever arm 113, to allow room for rotation of the actuator bracket 125 into its rest position. Thus, in the rest or end position, the lever arm 113, upper actuator bracket 125, and hydraulic actuator 112 are compactly and conveniently stowed beneath the lever bracket 111 and adjacent upright support 109. Moreover, each of lever arm 113, hydraulic actuator 112, and upright support 109 is in generally parallel relation with the other two components, while upper actuator bracket 125 is disposed generally perpendicular to these three components. As further discussed herein, this rest or end position also corresponds to a folded stage for each of these components.

The exercise apparatus 101 also derives additional practical benefits from the extension of the lever bracket 111. The extension of the lever bracket 111, according to the invention, allows the user to move the lever arm 113 through a dynamic exercise range from 0° to 180°. This way, full exercise benefits may be derived through exercise using the lever arm 113. These benefits are in addition to the folding and stowage benefits provided by this combination lever bracket 111, actuator 112, upright support 109 and lever arm 113 structure.

Now turning to FIG. 4, the lever arm 113 and exercise bar 115, according to the invention, is rotatable from the topmost orientation shown in FIG. 1 to a bottom most orientation. The lever arm 113 is, therefore, pivotable about the hinge 114 through a span of about 180°. To accomplish this feature in the exercise apparatus 101, the lever bracket 111 sufficiently extended from the upright bar 109 and the lower actuator bracket 110 is positioned sufficiently spaced below of the lever bracket 111. Because of the forwardly extension of lever bracket 111, the exercise bar 115 and lever arm 113 does not interfere with the upright support 109 or the hydraulic actuator 112, as shown in the detail of FIG. 4A. Moreover, the lever bracket 111 provides sufficient space XX between upright support 109 and lever arm 113 so as to accommodate the actuator 112 and also the actuator bracket 125.

Figure 5:
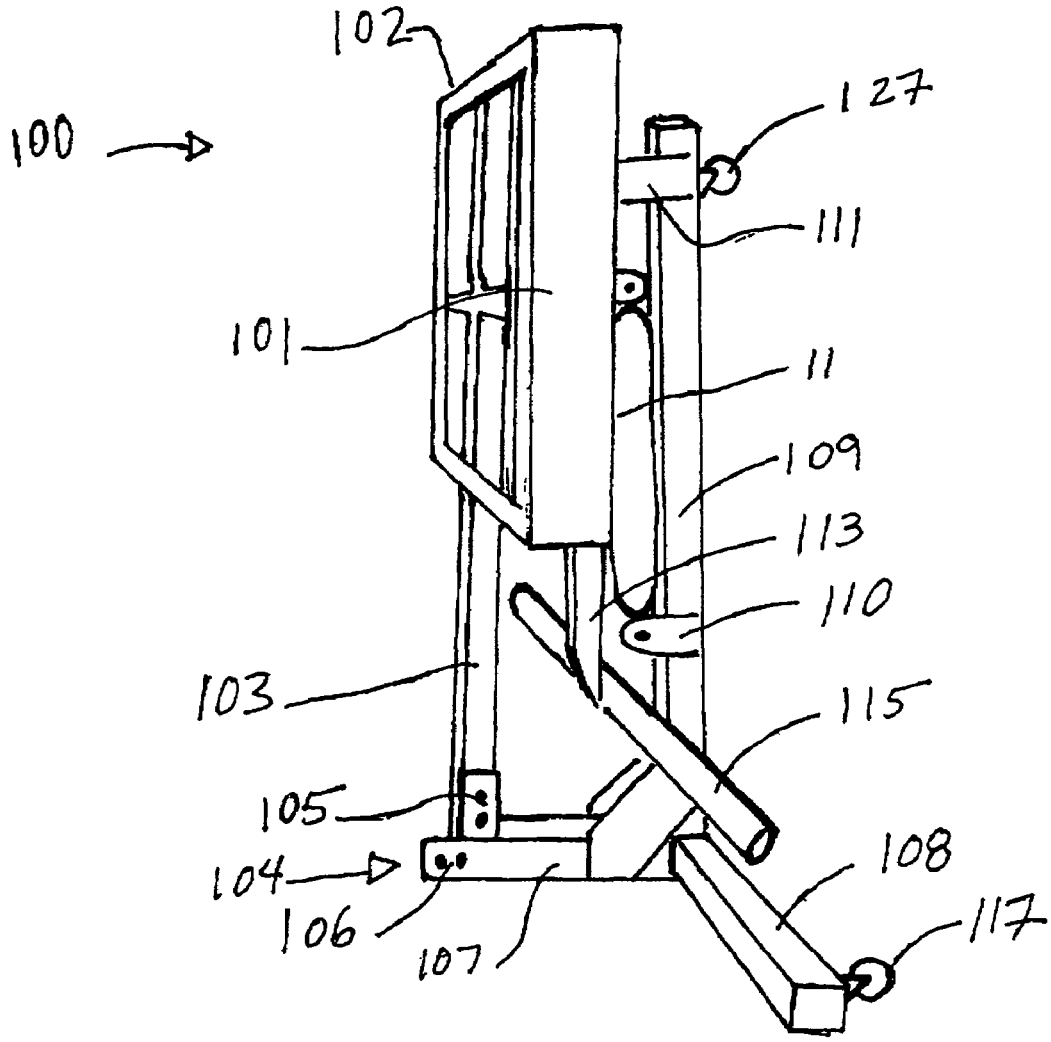
FIG. 5 is a perspective view of the exercise apparatus in FIG. 1 in a folded stage.
Figure 5A:
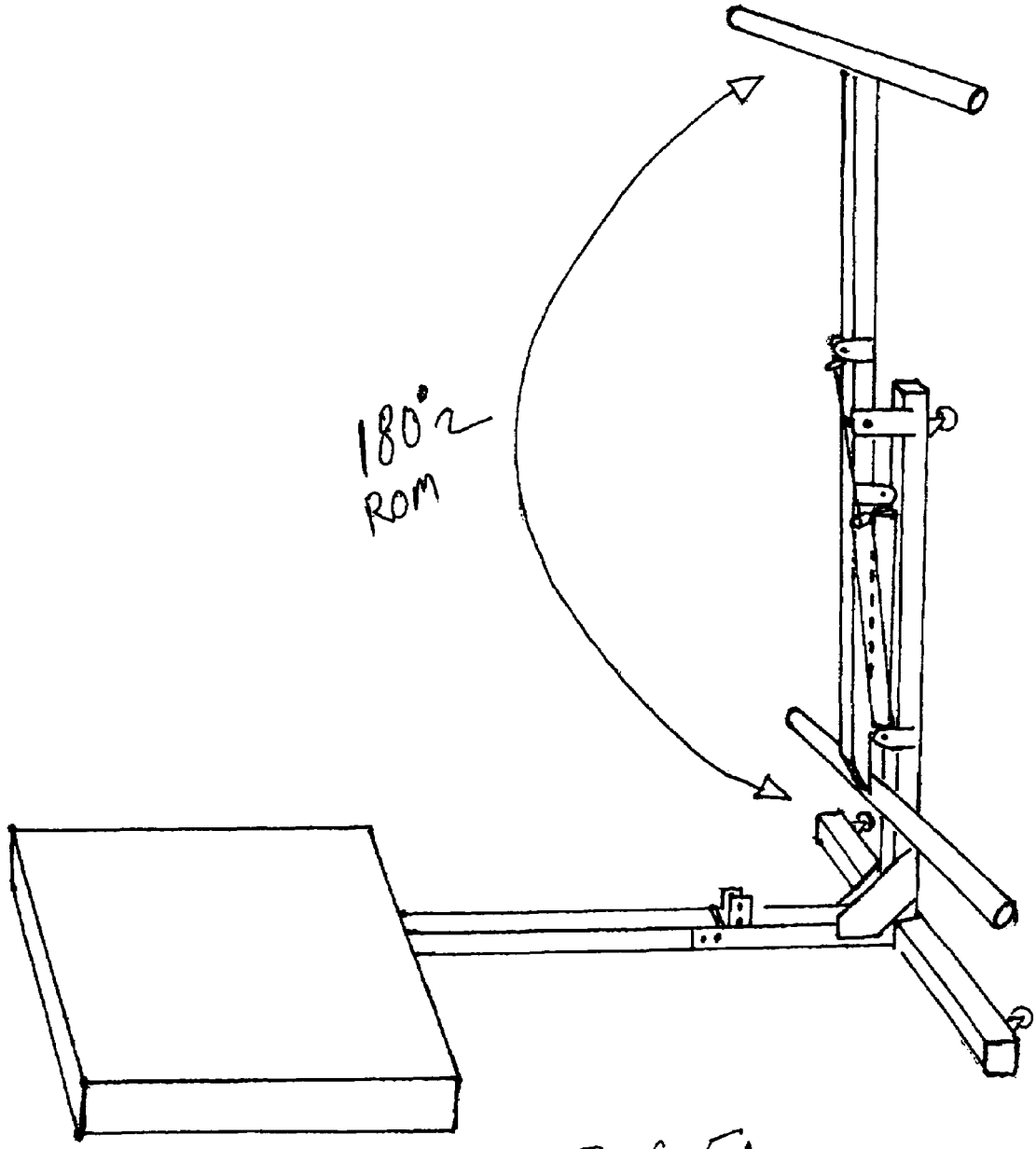
FIG. 5A is a detail view illustrating the movable range of an exercise bar of the exercise apparatus.

Now turning to FIG. 5, the exercise apparatus 100 is shown in a second stage of folding. The bottom rail 103 and platform 101 is pivotable about the lower pivot 106. In this way, the bottom rail 103 and platform 101 may be rotated uprightly by about 90° toward the folded lever arm 113, exercise bar 115, and upright support 109. As will become apparent to one of general skill in the relevant art, the stationary rail portion 107 is sufficiently extended from the upright support 109 and from joint JJ (and upright support 109) and further, from lever bracket 111 in the lateral direction, such that the pivot 106 is located forwardly of the hinge 114. In this way, the bottom rail 103 may be rotated upwardly to a generally vertical (90°) position adjacent the folded lever arm 113, actuator 112, and upright support 109, without interfering therewith. In this generally vertical position, the bottom rail 103 may be referred to as being in its folded stage. Notably, the stationary rail 106 is provided with lock mechanisms 105, that can be used to pin and secure the bottom member 103 in the generally vertical position. This provides an advantage during stowage of the exercise apparatus 101 as well as movement of the exercise apparatus 100 by the user, as will be further described below.

As shown in FIG. 5, the exercise apparatus 100 in the folded stage provides for the major components being conveniently compacted and disposed in a relatively stable position. In addition, stability is provided by a base rail 108 having a weight and extension to counter any moment provided by the components in upright folded stages. Furthermore, the lower rail extension 107 is provided at a length, such that in conjunction with the base rail 108, provides a stable base to the folded exercise apparatus 101. Moreover, the locking mechanism 105 secures, not only the bottom rail 103 and the vertical position, but secures and locks further the folded engagement of the bottom rail 103, lever arm 113, and upright support 109. By engaging a lock with the locking mechanism 105, the user is assured that the exercise apparatus 101 will not unfold during stowage and, further, during transport. It is also noted that the hydraulic actuator 112, to some extent, will, resist movement of the lever arm 113 and exercise bar 115 during stowage and transport. Furthermore, the bottom rail 103, and more particularly, the larger platform 101 will prevent the folded lever arm 113 from any considerable movements, should the actuator 112 provide only minimal resistance.

Figure 6:
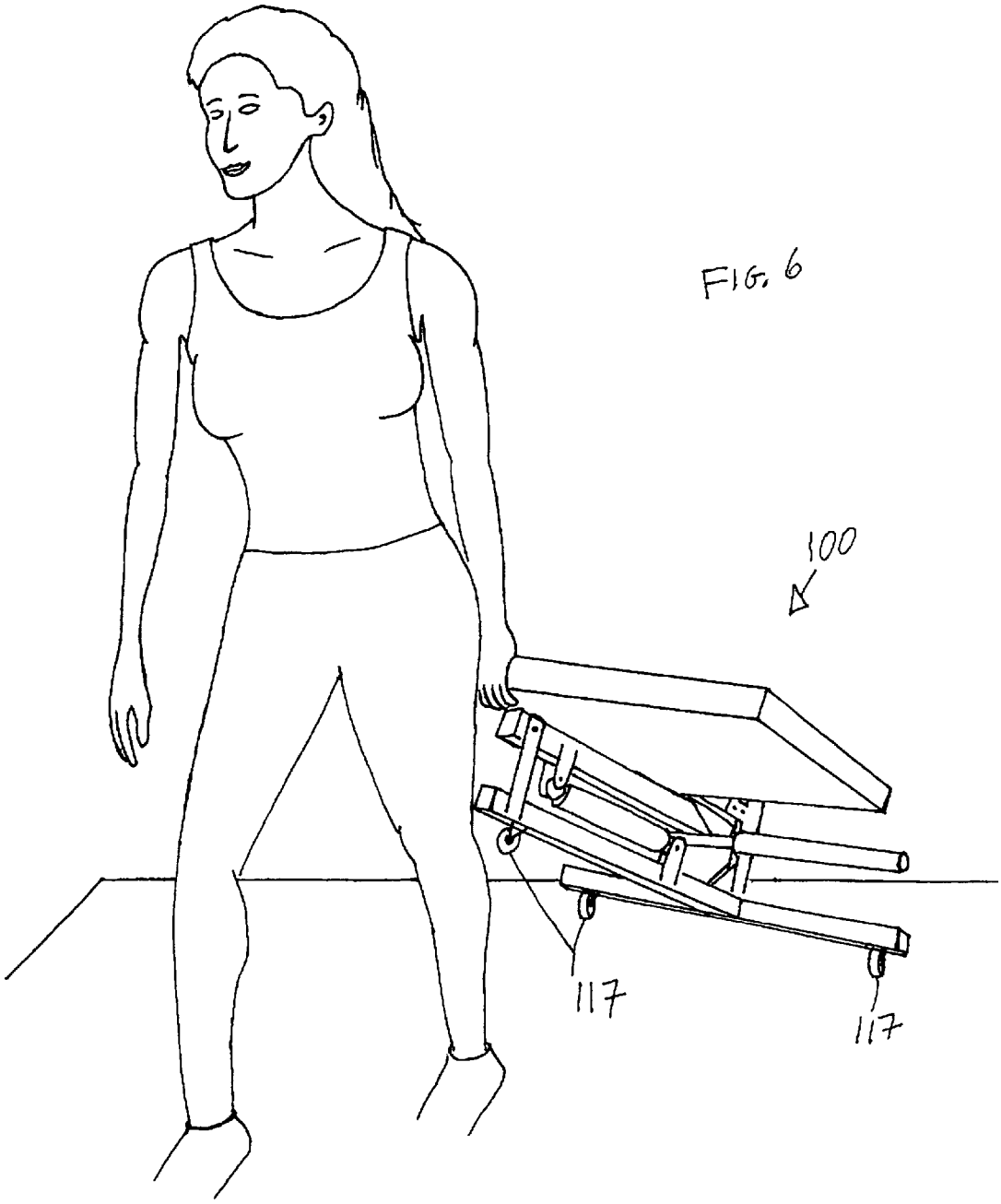
FIG. 6 is an illustration of the exercise apparatus in a folded, readily mobile stage.

As shown in FIG. 5, the exercise apparatus may be maintained in this upright folded stage during non-use, with a minimal foot print. In a further aspect of the present invention, the exercise apparatus 100 includes a set of wheels 117 on the base rail 103, and a third wheel 127 on a top end of upright support 109. The wheels 117 may be any suitable type of rollable supports, including casters. The set of wheels 117 preferably consists of a pair of wheels 117 at generally opposite ends of the base rail 108. The wheels 117 are mounted on a vertically inclined surface of the base rail 108, so that the folded exercise apparatus 100, as shown in FIG. 4, may be turned downwardly to rest on the three wheels. Accordingly, the exercise apparatus 100 may be conveniently rolled and transported or simply stowed in the upright stage with the wheels 117 raised above the surface SS. For example, the folded exercise apparatus 100 may be folded underneath a bed or some other storage space. Furthermore, as shown in FIG. 6, the apparatus 100 may be readily transported in the folded configuration. Simply, the user may pull the folded exercise apparatus from the edge of the platform 101 (or a handle or extension arm provided thereabout) while the rest of the apparatus 101 is rollably supported by wheels 117.

In a preferred embodiment of the invention, the base rail is approximately 29 inches long, and the upright support extends upwardly to a height of about 43 inches. Extension of the bottom rail 103 from the joint JJ to the platform is about 24 inches, and with the width/length of the platform 101, that extension is about 53 inches. Further, the lever arm 113 is provided at a length of about 32 inches and at its topmost or 0° position, the actuator 112 extends the full length of about 34½ inches noting that the actuator 112 itself is 21 inches and the extension is about 13½ inches. At this topmost or 0° position, the diagonal length from the top of the lever arm 113 from the exercise bar 115 to the back of the platform 101 is about 85 inches. This diagonal length defines a boundary of the exercise space according to the invention. This diagonal length (85 inches) along with the extended bottom rail length (53 inches) and the total height of the upright support and lever arm 113 (73 inches) defines some of the boundaries of the exercise space according to the present invention. Furthermore, in this preferred embodiment, the lever bracket 111 has a length of about 5¾ inches, thereby providing a space between the lever arm 113 and the space XX between the lever arm 113 (and exercise bar 115) and the upright support 109 of about 2 inches. This space XX accommodates the actuator bracket 125 and hydraulic actuator 112 in the folded stages of the exercise apparatus 100. To further accommodate the folded stages of the exercise apparatus 100 of the preferred embodiment, the stationary rail portion 107 is provided at a length of about 7½ inches. It is noted that these dimensions are provided, herein, to further teach the invention, including preferred embodiments of the invention. Accordingly, these dimensions should not be construed as limiting the invention in any way.

The foregoing description of the present invention has been presented for purposes of illustration and description of preferred embodiments. It is to be noted that this description is not intended to limit the invention to the various systems, apparatus, structures, and methods disclosed herein. Various aspects of the invention, as described above, may be applicable to other types of machinery, particularly exercise machines, and in combination with other exercise machine components. For example, the structure providing the folding attributes of the exercise apparatus may be applied to a different type of exercise apparatus having a geometrically different exercise bar or resistance means (other than hydraulic actuator 112) or an exercise apparatus without a platform or without rolling transports capabilities. Conversely, the structural configuration illustrated in FIGS. 1-6 may be changed, without departing from the spirit of the invention. Such variations of the invention will become apparent to one skilled in the relevant mechanical, machine or kinetics art, upon provision of the present disclosure. Consequently, variations and modifications commensurate with the above teachings, and the skill and knowledge of the relevant are, are within the scope of the present invention. The embodiments described and illustrated herein are further intended to explain the best and preferred modes for practicing the invention, and to enable others skilled in the art to utilize the invention and other embodiments and with various modifications required by the particular applications or uses of the present invention.

What is claimed is:

1. An exercise apparatus comprising:

a base;

a longitudinally extended bottom member directed generally transverse to the base;

an upright support;

an elongated lever arm, including an exercise bar;

a resistance member including a first end connected with the lever arm and an opposing second end connected with the upright support such that the resistance member impedes movement of the lever arm with respect to the upright support; and an extension arm extending generally laterally from the upright support and having a pivot connection about which the lever arm is pivotally connected;

wherein the lever arm is movable to a folded stage adjacent the upright support, and the bottom member is movable toward the upright support to a folded stage; and wherein the lever arm and the upright support are spaced apart by the extension arm such that the lever arm is rotatable through about 180 degrees from between a top position and a bottom position and such that a lateral space is provided beneath the fixed extension arm in which the lever arm is disposed in the folded stage at an orientation generally parallel with the upright support; and wherein the first end of the resistance member is connected with the lever arm via a pivot connection on one end of an upper bracket, the upper bracket being connected on an opposite end to the lever arm between the exercise bar and the pivot connection of the extension arm and extending generally transversely away therefrom, and wherein the second end of the resistance member is connected with the upright support via a pivot connection on a lower bracket that is extended generally laterally from the upright support, such that when the lever arm is disposed in the folded stage at an orientation generally parallel with the upright support, the upper bracket and the resistance means are disposed in the lateral space between the lever arm and the upright support and the upper bracket is generally parallel with the lower bracket.

2. The exercise apparatus of claim 1, wherein the folded stage of the lever arm lies at a bottom position of the normal range of motion of the lever arm during operation.

3. The exercise apparatus of claim 1, wherein the folded stage of the bottom member is adjacent the folded lever arm and opposite the upright support.

4. The exercise apparatus of claim 3, wherein the bottom member in the folded stage is positioned generally in parallel relation with the folded lever arm and with the upright support.

5. The exercise apparatus of claim 3, wherein the resistance member is a hydraulic actuator.

6. The exercise apparatus of claim 5, wherein the hydraulic actuator is movable to a folded stage corresponding to the folded stage of the lever arm and wherein, in the folded stage, the hydraulic actuator is positioned between the lever arm and the upright support.

7. The apparatus of claim 1, wherein the upright support is oriented generally vertically about 90 degrees from the base member and the lever arm is movable to an orientation generally parallel with the upright support.

8. The apparatus of claim 1, wherein the resistance member is configured positionable in the lateral space in a folded stage corresponding to the folded stage of the lever arm.

9. The exercise apparatus of claim 1, wherein the base comprises a base rail and the bottom member extends from a proximal end adjacent the base rail to a distal end provided by a platform having a transverse dimension substantially greater than a width of the extended base rail.

10. The exercise apparatus of claim 1, wherein the bottom member, and the upright support and lever arm frame an unobstructed exercise space therebetween.

11. The exercise apparatus of claim 1, wherein the base is a slender structural member extending lengthwise in a direction generally traverse to the bottom member.

12. The exercise apparatus of claim 1, further comprising an engageable lock mechanism configured to secure the bottom member in the folded stage upon being engaged.

13. The exercise apparatus of claim 12, wherein upon the engageable lock mechanism being engaged while the bottom member is in the folded stage and the lever arm is in the folded stage, the bottom member restrains the lever arm to maintain the folded stage of the lever arm.

14. An exercise apparatus comprising:

a base;

a longitudinally extending bottom member directed generally transverse to the base;

an upright support;

an elongated lever arm, including an exercise bar, connected to the upright support and pivotable thereabout, the lever arm and upright support being relatively disposed such that the lever arm is rotatable through about 180 degrees from between a top position and a bottom position; and a resistance member including a first end connected with the lever arm and an opposing second end fixed to the upright support such that the resistance member impedes movement of the lever arm with respect to the upright support; and wherein the upright support further includes a fixed extension arm fixed to the upright support having a pivot connection about which the lever arm is pivotably connected, the extension arm being laterally extended to provide a lateral space beneath the extension arm that accommodates each of the lever arm and the resistance member in the bottom position; and wherein the first end of the resistance member is connected with the lever arm via a pivot connection on one end of an upper bracket, the upper bracket being connected on an opposite end to the lever arm between the exercise bar and the pivot connection of the extension arm and extending generally transversely away therefrom, and wherein the second end of the resistance member is connected with the upright support via a pivot connection on a lower bracket that is extended generally laterally from the upright support, such that when the lever arm is disposed in the folded stage at an orientation generally parallel with the upright support, the upper bracket and the resistance means are disposed in the lateral space between the lever arm and the upright support and the upper bracket is generally parallel with the lower bracket.

15. The exercise apparatus of claim 14, wherein the bottom member includes an exercise platform at a distal end, and wherein the bottom member and the upright support frame an unobstructed exercise space therebetween, the lever arm being movable through the exercise space.

* * * * *